US008979305B2

(12) United States Patent
Sachsenweger

(10) Patent No.: US 8,979,305 B2
(45) Date of Patent: Mar. 17, 2015

(54) ILLUMINATION DEVICE HAVING A HEAT SINK AND METHOD FOR DIRECTING A LIGHT BUNDLE EMITTED BY AN ILLUMINATION DEVICE

(75) Inventor: Peter Sachsenweger, Zeitlarn (DE)

(73) Assignee: Osram GmbH, Munich (DE)

( * ) Notice: Subject to any disclaimer, the term of this patent is extended or adjusted under 35 U.S.C. 154(b) by 179 days.

(21) Appl. No.: 13/822,664

(22) PCT Filed: Aug. 30, 2011

(86) PCT No.: PCT/EP2011/064914

§ 371 (c)(1),
(2), (4) Date: Mar. 13, 2013

(87) PCT Pub. No.: WO2012/034851

PCT Pub. Date: Mar. 22, 2012

(65) Prior Publication Data

US 2013/0182437 A1 Jul. 18, 2013

(30) Foreign Application Priority Data

Sep. 16, 2010 (DE) ..... 10 2010 040 892

(51) Int. Cl.

| | |
|---|---|
| ***F21V 29/00*** | (2006.01) |
| ***F21V 21/096*** | (2006.01) |
| ***F21V 21/15*** | (2006.01) |
| ***F21V 21/29*** | (2006.01) |
| *F21Y 101/02* | (2006.01) |

(52) U.S. Cl.

CPC ..... *F21V 29/22* (2013.01); *F21V 21/096* (2013.01); *F21V 21/15* (2013.01); *F21V 21/29* (2013.01); *F21V 29/004* (2013.01); *F21Y 2101/02* (2013.01)

USPC ..... 362/249.01; 362/249.02; 362/294

(58) Field of Classification Search

USPC ..... 362/249.01, 249.02, 249.03, 294

See application file for complete search history.

(56) References Cited

U.S. PATENT DOCUMENTS

| | | | | |
|---|---|---|---|---|
| 6,170,967 | B1 | 1/2001 | Usher et al. | |
| 7,538,289 | B2 | 5/2009 | Carroll | |
| 2006/0262523 | A1 | 11/2006 | Smith et al. | |
| 2011/0026252 | A1 * | 2/2011 | Janos et al. | 362/249.02 |

FOREIGN PATENT DOCUMENTS

| | | | |
|---|---|---|---|
| DE | 745814 | C | 4/1944 |
| DE | 3448084 | A1 | 9/1986 |
| DE | 8914528 | U1 | 3/1990 |
| DE | 102004019135 | A1 | 11/2005 |
| DE | 102008007647 | A1 | 8/2009 |
| WO | 2010097733 | A1 | 9/2010 |

OTHER PUBLICATIONS

English language abstract of DE 102004019135A1 of Nov. 17, 2005.
English language abstract of DE 102008007647A1 of Aug. 13, 2009.
English language abstract of DE 3448084A1 of Sep. 4, 1986.

* cited by examiner

*Primary Examiner* — David V Bruce

(57) ABSTRACT

An illumination device may include a heat sink, on which at least one light source is fastened at least indirectly, wherein the heat sink is held movably in a holder in such a way that the heat sink moves with greater difficulty in an energized state of the light source than in a de-energized state of the light source.

14 Claims, 3 Drawing Sheets

ILLUMINATION DEVICE HAVING A HEAT SINK AND METHOD FOR DIRECTING A LIGHT BUNDLE EMITTED BY AN ILLUMINATION DEVICE

RELATED APPLICATIONS

The present application is a national stage entry according to 35 U.S.C. §371 of PCT application No.: PCT/EP2011/064914 filed on Aug. 30, 2011, which claims priority from German application No.: 10 2010 040 892.1 filed on Sep. 16, 2010.

TECHNICAL FIELD

Various embodiments relate to an illumination device, e.g. a semiconductor illumination device, having a heat sink. Various embodiments also relate to methods for directing a light bundle emitted by an illumination device, e.g. a semiconductor illumination device.

BACKGROUND

Luminaires with a lampholder for light-emitting means, wherein the lampholder can be aligned manually by means of a mechanical joint, are known. The mobility of the joint is fixedly predetermined by the manufacture or is manually adjustable by a user.

The known illumination devices have the common disadvantage that heat dissipation through the joint is quite ineffective and cooling of the light-emitting means takes place exclusively by means of a heat sink provided between the joint and the light-emitting means, which is problematic in particular in the case of compact and high-power luminaires.

SUMMARY

Various embodiments may at least partially avoid the disadvantages of the prior art and may e.g. provide an illumination device which can be directed with respect to light emission and has improved heat dissipation.

Various embodiments provide an illumination device, having a heat sink, on which at least one light source is fastened at least indirectly, wherein the heat sink is held movably in a holder in such a way that the heat sink moves with greater difficulty in an energized state of the light source than in a de-energized state of the light source.

The increased difficulty of movement corresponds at least locally to an increased contact pressure between the holder and the heat sink. In the energized state, this reduces the thermal transfer resistance between the heat sink and the holder, which improves heat dissipation from the heat sink onto the holder and therefore cooling of the at least one light source. In particular, the heat can be dissipated further from the holder, for example to an external heat sink. The heat sink therefore serves at least to dissipate heat from the at least one light source onto the holder, but can also be designed for heat transfer to the surrounding medium, for example for heat transfer by means of convection.

The greater difficulty of movement in the energized state can also prevent the fit of the heat sink in the holder being loosened at elevated temperatures. In particular, a frictional contact between the heat sink and the holder which decreases owing to the development of heat can be compensated for or overcompensated for.

Preferably, the at least one light source includes at least one light-emitting diode. In the case of the provision of a plurality of light-emitting diodes, said light-emitting diodes can illuminate in the same color or in different colors. A color may be monochrome (for example red, green, blue, etc.) or multichrome (for example white). The light emitted by the at least one light-emitting diode can also be an infrared light (IR-LED) or an ultraviolet light (UV-LED). A plurality of light-emitting diodes can produce a mixed light, for example a white mixed light. The at least one light-emitting diode can contain at least one wavelength-converting phosphor (conversion LED). The at least one light-emitting diode can be present in the form of at least one individually housed light-emitting diode or in the form of at least one LED chip. A plurality of LED chips can be mounted on a common substrate ("submount"). The at least one light-emitting diode can be equipped with at least one dedicated and/or common optical element for beam guidance, for example at least one Fresnel lens, collimator, etc. Instead of or in addition to inorganic light-emitting diodes, for example on the basis of InGaN or AlInGaP, organic LEDs can generally also be used (OLEDs, for example polymer OLEDs). Alternatively, the at least one light source can have at least one diode laser, for example. However, the light source is not restricted to a semiconductor light source and may also include, for example, a halogen lamp, a fluorescent tube etc.

The at least one light source, in particular light-emitting diode, can be arranged in particular on a front side of a light source substrate (for example a printed circuit board), wherein the light source substrate can be fastened with its rear side flat on the heat sink, in particular via a thermal interface material (TIM) such as a thermally conductive film, a thermally conductive paste, a thermally conductive adhesive etc.

One configuration consists in that the heat sink is manually movable in the de-energized state of the light source and is substantially fixed with respect to manual manipulation in the energized state of the light source. This provides the safety feature that a user needs to switch off the illumination device in order to mechanically adjust the heat sink, as a result of which the risk of burning is reduced. "Substantially fixed with respect to manual manipulation" can in particular be understood to mean that a user cannot adjust the heat sink manually or can only do so using a large amount of force or violence.

A further configuration consists in that the heat sink and the holder form a joint. This enables particularly simple fastening and movability of the heat sink on the holder.

A further configuration consists in that the heat sink and the holder form a rotary joint. This enables an alignment of a light beam emitted by the illumination device into a wide three-dimensional area.

For this purpose, the rotary joint is preferably in the form of a ball joint since the ball joint enables a compact structural form and a particularly simple three-axis alignment. However, the rotary joint is not restricted to a ball joint, but can also be in the form of an ellipsoidal joint, a saddle joint, a hinge joint or a pin joint, for example.

In addition, one configuration consists in that the heat sink forms a joint head and the holder forms a joint socket or joint receptacle accommodating the joint head. Alternatively, the joint socket can be formed in the heat sink and the joint head in the holder. The joint socket can in particular be formed as a component part with an at least substantially negative contour with respect to the joint head.

A further configuration consists in that the heat sink has a resting face for a light source substrate at an end opposite the joint head. As a result, the pivot point of the heat sink is positioned at an opposite end of the heat sink to the light source substrate, as a result of which the light source substrate and therefore the at least one light source arranged thereon can be pivoted to a particularly wide extent.

A configuration also consists in that the illumination device has at least one electromagnet, which produces a contact force between the heat sink and the holder in the energized state of the light source.

The use of the at least one electromagnet has the advantage that it can be energized automatically when the at least one light source is also energized. As a result, when, during operation of the at least one light source, a large quantity of heat needs to be dissipated, the heat dissipation can automatically be improved. In addition, an electromagnet can be integrated in the holder and/or in the heat sink in a comparatively simple manner in terms of manufacture. The electromagnet can in particular be in the form of a coil with one or more turns. The at least one electromagnet can be arranged on the holder, on the heat sink or on both. It is particularly advantageous for a wired power supply to the electromagnet if at least one electromagnet is integrated in the holder.

In addition, a configuration consists in that the illumination device has at least one permanent magnet, which produces a contact force, in particular attractive force, between the heat sink and the holder.

This contact force is largely independent of a fit of the heat sink in the holder and therefore also acts in the case of an otherwise mechanically loose holding of the heat sink, with the result that an alignment of the heat sink can then still be maintained. An integration of the at least one permanent magnet is also easily possible in terms of manufacture.

The at least one permanent magnet can be integrated in the holder and/or in the heat sink. The respective other body has in particular at least one magnetic region, on which a magnetic force can be exerted by the permanent magnet. This magnetic region may include, for example, a magnetic material, in particular a ferromagnetic or ferrimagnetic material or have another permanent magnet with suitable polarization and alignment.

Consequently, a development consists in that the at least one permanent magnet is integrated in the holder (in particular on or in the vicinity of a contact face with the heat sink) and the heat sink has, at least regionally (in particular on or in the vicinity of its contact face with the holder or in the vicinity of the at least one permanent magnet of the holder), at least one magnetic region.

An alternative development consists in that the heat sink has the at least one permanent magnet and the holder has the at least one magnetic region in an effective region of the at least one permanent magnet of the heat sink.

A further alternative development consists in that both the holder and the heat sink are equipped with permanent magnets, which can attract one another or magnetic regions of the respective other body, for example. Mutually opposite permanent magnets which are arranged in different bodies can also repel one another.

In particular, the holder and/or the heat sink can be present in the form of at least one volume component part consisting of a substantially nonmagnetic material, into which component part(s) at least one permanent magnet and/or a magnetic region is integrated. The holder and/or the heat sink can be present as (a) plastics part(s) or as (an) aluminum part(s), in particular (an) aluminum diecast part(s), for example.

It is preferable if a surrounded region of the rotary joint (for example a joint head) has a higher coefficient of thermal expansion than the region surrounding it. Independent adjustment of the alignment can also thus be at least partially prevented at relatively high temperatures, for example when no permanent magnets are provided.

A development consists in that the at least one permanent magnet and/or the at least one electromagnet (each) include(s) a plurality of magnets. Thus, an at least approximately constant contact force between the holder and the heat sink can also be maintained for different alignments of the heat sink in a simple manner. Alternatively, the magnet and/or the magnetic region can be an individual magnet or magnetic region, in particular with a large volume.

A further development consists in that the holder and the heat sink are pulled towards one another by the magnets. However, it is also possible for a repelling force to be produced between the holder and the heat sink by the magnets (in particular by magnet faces of identical polarity being arranged opposite one another), as a result of which the heat sink is pushed away from the holder locally in the region of the magnets and is pressed with greater force against the holder at another contact region which is no longer directly influenced by the magnetic force.

An alternative or additional configuration consists in that the holder is constructed from at least two parts in such a way that the heat sink is held so as to be pressed in or clamped in between the parts of the holder. The parts of the holder therefore exert a contact pressure (and a frictional force which correspondingly counteracts a movement of the heat sink) on the heat sink, as a result of which a movement of the heat sink can only be prevented owing to the force of gravity.

The illumination device also has at least one electromagnet, which produces an attractive force between the at least two parts of the holder in the energized state. In the energized state, the two parts of the holder are drawn together with greater strength, with the result that the heat sink is forced or clamped in between the two parts to a greater extent, as a result of which a thermal transfer resistance at the at least one contact face is reduced and the ability of the heat sink to move in the holder is decreased.

The contact pressure on the heat sink can be achieved, for example, by virtue of the fact that the parts of the holder are pushed together or drawn together, for example by means of a magnetic force, a spring force, etc. For example, the illumination device can have at least one element for producing a contact pressure, such as at least one permanent magnet and/or at least one spring, which produces an attractive force between the at least two parts of the holder. Therefore, in the de-energized state, the heat sink can be pressed or clamped in in the holder with a predetermined contact pressure by means of the permanent magnet, the spring etc.

In general, the magnets and/or magnetic regions can be arranged and dimensioned in such a way that a desired ability of the heat sink to move or run with respect to the holder is provided in a simple manner both in the de-energized state and in the energized state.

A development consists in that the at least one electromagnet is connected by wires to a corresponding power supply, in particular an AC source.

Alternatively, the at least one electromagnet can be supplied with energy inductively. This is particularly advantageous in the case of an arrangement of the at least one electromagnet in the heat sink or if it is technically complex to supply an electrical line or a movement of the heat sink would be too difficult to restrict. The inductive power supply can be provided by means of a further spaced-apart (primary) coil, which produces an alternating magnetic field at the location of the electromagnet during operation.

A further configuration consists in that a thermal interface material is integrated in the heat sink and/or in the holder on at least one contact face or on at least one region of the contact face between the heat sink and the holder. The thermal interface material serves to improve heat transfer between the heat sink and the holder. The thermal interface material can be, for example, a thermally conductive pad, a thermally conductive layer or a thermally conductive film. The thermal interface material is preferably substantially free of wear with respect to the contact forces on the contact region. The thermal interface material is additionally preferably elastic or sprung, with the result that it produces at the same time a defined mechanical contact pressure or a defined mechanical contact force between the heat sink and the holder. In general, the electromagnets, possibly in conjunction with the thermal interface material (TIM), can permanently compensate for any tolerances and material settlements which may occur.

Various embodiments provide a method for directing a light bundle emitted by an illumination device, wherein the illumination device has a heat sink, on which at least one light source is fastened at least indirectly, which is held movably in a holder, wherein when the light source is energized, the heat sink is pressed against the holder to a greater extent than in a de-energized state of the light source.

BRIEF DESCRIPTION OF THE DRAWINGS

The invention will be described in more detail schematically with reference to exemplary embodiments in the following figures, in which, for reasons of clarity, identical or functionally identical elements can be provided with the same reference symbols.

DETAILED DESCRIPTION

The following detailed description refers to the accompanying drawings that show, by way of illustration, specific details and embodiments in which the invention may be practiced.

Figure 1:
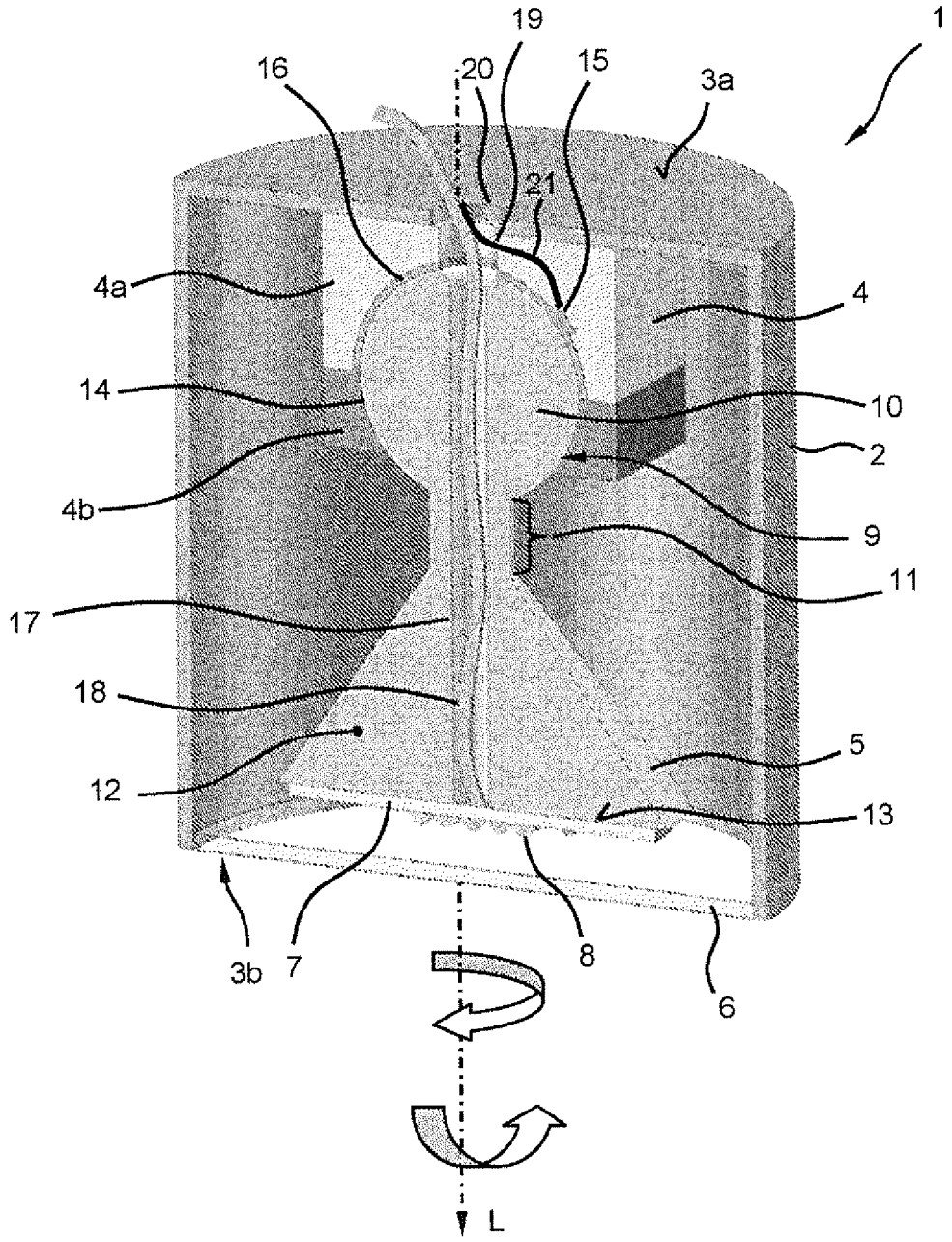
FIG. 1 shows a sectional illustration in a view at an angle of an illumination device in accordance with a first embodiment.

FIG. 1 shows a sectional illustration in a view at an angle of an illumination device 1 in accordance with a first embodiment. The illumination device 1 has a hollow-cylindrical housing 2, with a holder 4 being fastened on the inside to the closed cover face 3*a* of said housing. The holder 4 holds or bears a heat sink 5, wherein the heat sink 5 extends from the holder 4 in the direction of an open cover face 3*b* of the housing 2, which cover face 3*b* is opposite the closed cover face 3*a*. The open cover face 3*b* is covered by means of a transparent cover 6 in the form of a circular disk.

The holder 4 forms a cutout in the form of a sphere section and formed as a joint socket 9 for accommodating a fastening region 10 of the heat sink 5 which is in the form of a ball head. The fastening region 10 in the form of a ball head represents a rear end of the heat sink 5. In order to introduce the fastening region in the form of a ball head into the joint socket 9, the holder 4 is formed in two parts, to be precise with a first holder part 4*a* fastened to the cover face 3*a* and a second holder part 4*b* fastened to the first holder part 4*a*. The fastening region 10 in the form of a ball head can be inserted into the first holder part 4*a* up to its equator. The second holder part 4*b* adjoining the first holder part 4*a* can be formed in one or more pieces, wherein the fastening region 10 in the form of a ball head is accommodated with a region in the form of a ball section which is less than hemispherical in the second holder part 4*b*. Thus, the heat sink 5 can be held permanently in the holder 4. A three-axis movement of the heat sink 5 is enabled by means of the ball joint 9, 10, as is indicated by the two arrows, namely a two-axis pivoting movement in three dimensions and a rotary movement around its longitudinal axis L.

The heat sink 5 is first equipped with a pin-shaped section 11 adjoining the fastening region 10 in the form of a ball head, with a region in the form of a cone or truncated cone ("cone region" 12) adjoining said section 11 in the direction of the cover 6. The cone region 12 expands towards its free end, which corresponds to the relatively large base area of the cone region 12 ("free base area" 13). A light source substrate 7 rests with its rear side flat against the free base area 13, possibly connected by a thermal interface material. The thermal interface material (not depicted) may be a thermally conductive adhesive, for example. The light source substrate 7 is provided with a plurality of light sources in the form of light-emitting diodes 8 on its front side, said light-emitting diodes emitting radiation through the transparent cover 6 out of the housing 2. The heat sink 5 serves to conduct waste heat produced at the light-emitting diodes 8 onto the holder 4, which can further dissipate the heat, for example, to the housing or to a dedicated external heat sink (not depicted).

The heat sink 5 can be adjusted manually (pivoted and/or rotated about an axis) by a user, possibly once the cover 6 has been removed. No tool is required for this purpose.

An adjusted alignment is maintained by virtue of the fact that the heat sink 5 and the holder 4 are pressed one on top of the other at their contact region 14 by means of a contact force and a frictional force resulting therefrom prevents a movement of the heat sink 5 purely owing to the force of gravity.

It is possible in principle to achieve this contact force or contact-pressure force exclusively by mechanical means by corresponding adjustment of a fit between the heat sink 5 and the holder 4. In order to obtain the manually adjusted alignment of the heat sink 5 even in the case of a loosening of the fit (for example owing to a thermal expansion of the holder 4 or owing to wear), however, the holder 4 and the heat sink 5 are configured in such a way that they are magnetically permanently attracted to one another. For this purpose, for example, the heat sink 5 and/or the holder 4 can have permanently magnetic regions. In the configuration shown, for example, the first holder part 4*a* can be in the form of a permanent magnet or have permanently magnetic regions (not depicted), which attract the fastening region 10 in the form of a ball head to them. As a result, a (magnetic) contact force is produced between the holder 4 and the heat sink 5. As a result, it is even possible to dispense with a mechanical press fit or clamping fit. Since the magnetic force of attraction is substantially independent of conventional heating of an illumination device, a substantially constant contact force can be maintained in the de-energized state over a wide temperature range.

In addition, a plurality of electromagnets 15 are integrated in the first holder part 4*a* at the contact region 14 thereof with respect to the fastening region 10 in the form of a ball head. The electromagnets 15 make it possible for the fastening region 10 in the form of a ball head to be attracted to the holder 4 or to the first holder part 4*a* to an even greater extent by means of energization of the electromagnets 15. This also increases a frictional force between the holder 4 and the heat sink 5, with the result that it is thus more difficult or more force needs to be applied to move the heat sink 5 with respect to the holder 4.

By virtue of the attraction, heat transfer from the heat sink 5 which absorbs the waste heat produced by the light-emitting diodes 8 to the holder 4 and then to the housing 2 is also considerably improved. At the same time this prevents a user from easily being able to adjust the alignment of the heat sink 5 in an energized state.

In order to improve the heat transfer between the heat sink 5 and the holder 4, the holder 4 is equipped with a thermal interface material (TIM) 16 at a contact section of the first holder part 4*a*. The thermal interface material 16 is in this case an elastically deformable film or cushion, which together with the electromagnets 15 enables compensation for fit.

In order to supply electricity to the light-emitting diodes 8, the heat sink 5 has a cable channel 17 which is introduced centrally along the longitudinal axis and in which a cable 18 runs. The cable channel 17 ends at one end at a rear side of the light source substrate 7 and it is thus easily possible for electrical contact to be made with the light-emitting diodes 8. At the rear end of the heat sink 5, the cable channel 17 opens out into the rearmost region of the fastening region 10 in the form of a ball head. In the perpendicular alignment of the heat sink 5 shown, an appropriately sized cable channel 19 in the first holder part 4*a* adjoins the cable channel 17, said cable channel 19 being passed on through a corresponding cable bushing opening 20 in the closed cover face 3*a* of the housing 2. In the perpendicular alignment of the heat sink shown, in which the heat sink 5 assumes a symmetrical position with respect to the housing 2, therefore, a collinear or linear channel is formed by the cable channel 17 of the heat sink 5, the cable channel 19 of the holder 4 and the cable bushing opening 20 in the housing 2. Overall, the cable 18 can thus be passed through the closed cover face 3*a* up to the light source substrate 7. If the heat sink 5 is pivoted, the cable 18 can be guided along laterally by the wide embodiment of the channels 17 and 19 and the cable bushing opening 20 and neither impedes the alignment of the heat sink 5 nor becomes clamped in. By means of the cable 18, power can also be supplied to the electromagnets 15 by a corresponding branch line 21, which leads to the at least one electromagnet 15. Alternatively, the electromagnets 15 can be energized inductively, for example.

Figure 2:
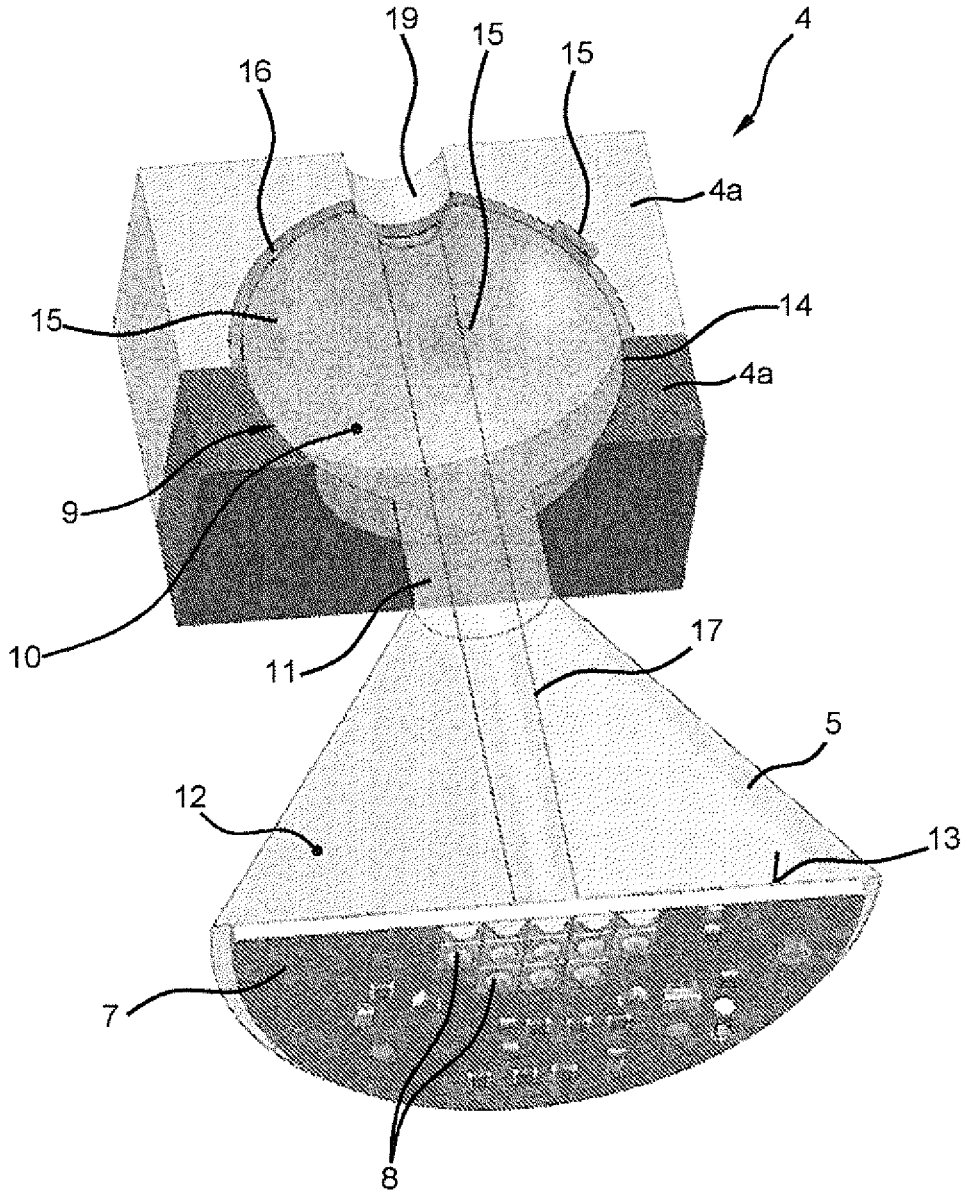
FIG. 2 shows elements of the illumination device in accordance with a first embodiment as a sectional illustration in a different view at an angle.

FIG. 2 shows the holder 4, the heat sink 5 and the light source substrate 7 equipped with the light-emitting diodes 8 as a sectional illustration in a different view at an angle.

Figure 3:
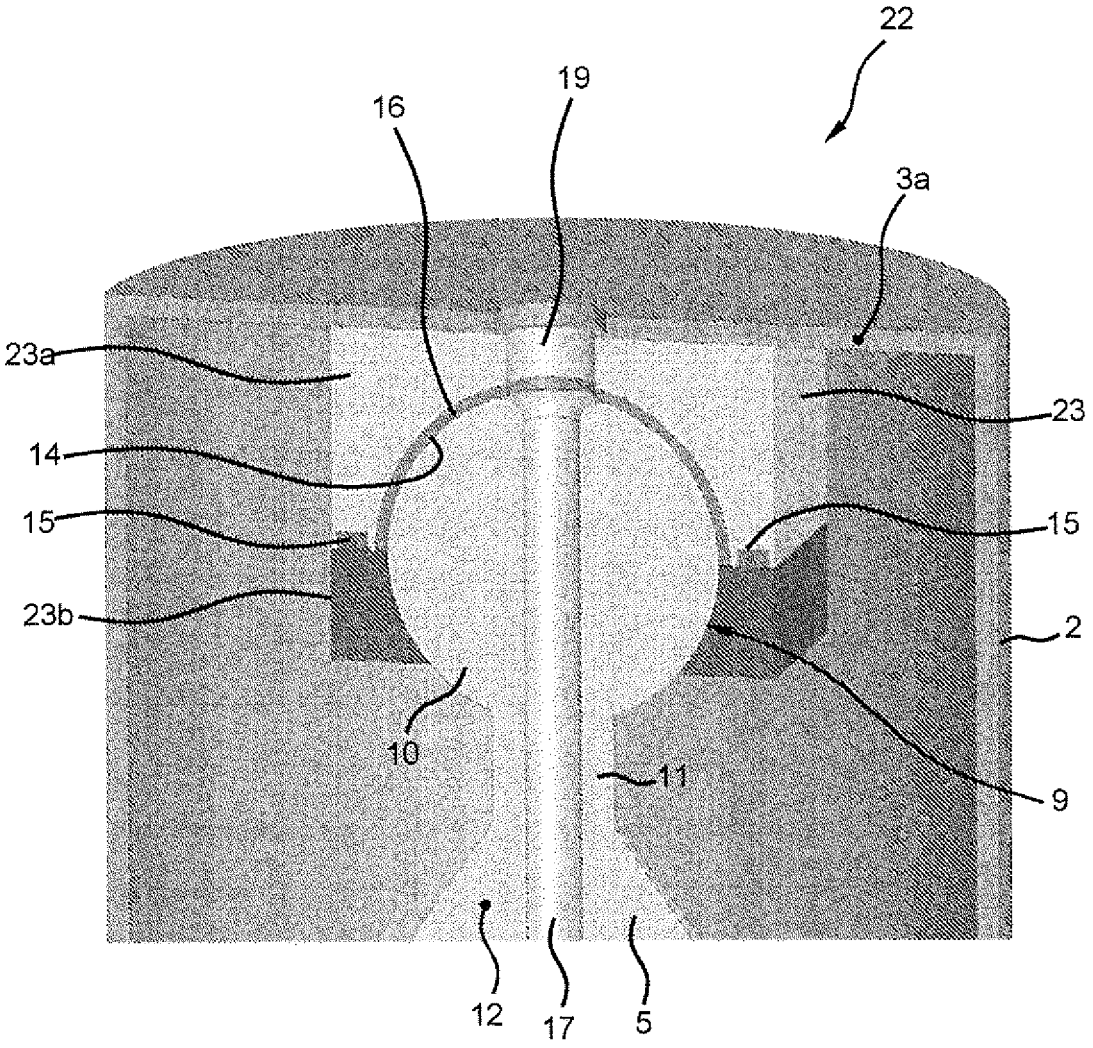
FIG. 3 shows a sectional illustration in a view at an angle of a detail of an illumination device in accordance with a second embodiment.

FIG. 3 shows a sectional illustration in a view at an angle of a detail of an illumination device 22 in accordance with a second embodiment. The illumination device 22 has a similar design to the illumination device 1, apart from the fact that a different holder 23 is used. In turn, the holder 23 has at least two parts, which in this case are represented by a first holder part 23*a* (which corresponds to the holder part 4*a* of the illumination device 1), and a second holder part 23 (which corresponds to the second holder part 4*b* of the illumination device 1).

However, in the case of the illumination device 22, no magnetic force of attraction is now produced between the holder 23 and the heat sink 5, but between the first holder part 23*a* and the second holder part 23*b*. The fastening region 10 in the form of a ball head of the heat sink 5 is thus held or mounted in the holder 4 in such a way that the two holder parts 23*a* and 23*b* hold the fastening region 10 in the form of a ball head with a press fit or a clamping fit. For this purpose, in a de-energized state, the two holder parts 23*a* and 23*b* attract one another permanently magnetically, for example by virtue of the first holder part 23*a* being in the form of a magnet or having magnetic regions and the second holder part 23*b* being magnetic, for example, or having at least one magnetic region (or vice versa). By virtue of the strength of the magnetic attraction between the holder parts 23*a* and 23*b*, the strength of the press fit and therefore the force required to move the heat sink 5 can be adjusted.

In the energized state, in which the light-emitting diodes 8 are activated, one or more electromagnets 15 are also energized, with the result that the second holder part 23*b* is attracted more strongly to the first holder part 23*a*. This also increases the strength of the press fit or the contact force exerted by the holder 23 on the heat sink 5. As a result, the thermal transfer resistance is reduced and it becomes more difficult to move the heat sink 5 relative to the holder 23.

In the embodiment shown, the electromagnet 15 can be, for example, an electromagnet, in particular a coil, which is located in the first holder part 23*a* and runs in the form of a ring around the fastening region 10 in the form of a ball head. In general, the at least one electromagnet 15 can also be located in the second holder part 23*b*, however, or both holder parts 23*a* and 23*b* can be equipped with in each case at least one electromagnet.

The present invention is of course not restricted to the exemplary embodiments shown.

Thus, the permanent magnets can also be dispensed with.

In addition, the cable can also be guided outside the ball joint, but at least partially within the illumination device.

The illumination device may be a lamp, a light-emitting module or a luminaire.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

LIST OF REFERENCE SYMBOLS

1 Illumination device
2 Housing
3*a* Closed cover face of housing
3*b* Open cover face of housing
4 Holder
4*a* First holder part
4*b* Second holder part
5 Heat sink
6 Transparent cover
7 Light source substrate
8 Light-emitting diode
9 Joint socket
10 Fastening region in the form of a ball head
11 Pin-shaped section
12 Cone region
13 Free base area
14 Contact region
15 Electromagnet
16 Thermal interface material
17 Cable channel
18 Cable
19 Cable channel
20 Cable bushing opening
21 Branch line
22 Illumination device
23 Holder
23*a* First holder part
23*b* Second holder part
L Longitudinal axis

The invention claimed is:

1. An illumination device, comprising:

a heat sink, on which at least one light source is fastened at least indirectly, wherein the heat sink is held movably in a holder in such a way that the heat sink moves with greater difficulty in an energized state of the light source than in a de-energized state of the light source.

2. The illumination device as claimed in claim 1, wherein the heat sink is manually movable in the de-energized state of the light source and is substantially fixed with respect to manual manipulation in the energized state of the light source.

3. The illumination device as claimed in claim 1, wherein the heat sink and the holder form a joint.

4. The illumination device as claimed in claim 1, wherein the heat sink and the holder form a rotary joint.

5. The illumination device as claimed in claim 4, wherein the heat sink forms a joint head and the holder forms a joint socket accommodating the joint head.

6. The illumination device as claimed in claim 5, wherein the heat sink has a resting face for a light source substrate at an end opposite the joint head.

7. The illumination device as claimed in claim 1, wherein the illumination device has at least one electromagnet, which produces a contact force between the heat sink and the holder in the energized state of the light source.

8. The illumination device as claimed in claim 7, wherein the illumination device has at least one permanent magnet, which produces a contact force between the heat sink and the holder.

9. The illumination device as claimed in claim 1, wherein the holder is constructed from at least two parts in such a way that the heat sink is held between the parts of the holder and the illumination device has at least one electromagnet, which produces an attractive force between the at least two parts of the holder in the energized state of the light source.

10. The illumination device as claimed in claim 9, wherein the illumination device has at least one element for producing a contact force, which element produces an attractive force between the at least two parts of the holder.

11. The illumination device as claimed in claim 7, wherein the at least one electromagnet is configured to be supplied with energy inductively.

12. The illumination device as claimed in claim 1, wherein a thermal interface material is integrated at least one of in the heat sink and in the holder on at least one contact face between the heat sink and the holder.

13. A method for directing a light bundle emitted by an illumination device, the method comprising:

providing the illumination device having a heat sink, on which at least one light source is fastened at least indirectly and which is held movably in a holder, and when the light source is energized, pressing the heat sink against the holder to a greater extent than in a de-energized state of the light source.

14. The illumination device as claimed in claim 4, wherein the heat sink and the holder form a ball joint.

* * * * *